US006618961B1

(12) United States Patent
Palau

(10) Patent No.: US 6,618,961 B1
(45) Date of Patent: Sep. 16, 2003

(54) THERMOFORMABLE MULTI-PART SLIPPER

(75) Inventor: Alain Palau, Pontacq (FR)

(73) Assignee: L'Aubisque ets Palau, SA, Pontacq (FR)

( * ) Notice: Subject to any disclaimer, the term of this patent is extended or adjusted under 35 U.S.C. 154(b) by 0 days.

(21) Appl. No.: 09/445,371

(22) PCT Filed: Jun. 2, 1998

(86) PCT No.: PCT/FR98/01102

§ 371 (c)(1),
(2), (4) Date: Jan. 18, 2000

(87) PCT Pub. No.: WO98/54997

PCT Pub. Date: Dec. 10, 1998

(30) Foreign Application Priority Data

Jun. 4, 1997 (FR) ..... 97 07008

(51) Int. Cl.[7] ..... A43B 23/00; A41D 27/24

(52) U.S. Cl. ..... 36/57; 2/275; 602/65; 112/421

(58) Field of Search ..... 623/29, 23.58; 36/8.1, 10, 88, 93, 57; 2/239, 241, 2.15, 275; 602/6, 7, 23, 27, 65; 12/142 R; 156/93; 112/421

(56) References Cited

U.S. PATENT DOCUMENTS 1,617,462 A * 2/1927 Schamberg ..... 36/8.1
4,277,959 A * 7/1981 Thorneburg ..... 2/239
4,416,027 A * 11/1983 Perla ..... 2/275
4,523,392 A * 6/1985 Gabrielli ..... 36/88
4,685,453 A 8/1987 Guignard et al.
5,392,535 A * 2/1995 Van Noy et al. ..... 36/88
5,802,742 A * 9/1998 Baude et al. ..... 36/10
6,030,418 A * 2/2000 Biedermann ..... 623/36

FOREIGN PATENT DOCUMENTS

FR 2 738 999 A 3/1997
WO WO 94 09663 A 5/1994
WO WO 96 07339 A 3/1996

* cited by examiner

*Primary Examiner*—Bruce Snow
*Assistant Examiner*—Brian E Pellegrino
(74) *Attorney, Agent, or Firm*—Harrison & Egbert

(57) ABSTRACT

A device for fitting onto a foot and ankle of a human body which is a thermoformable element suitable for being thermoformed onto the foot. This element includes a first part and a second part which are joined together in an edge-edge relationship. Each of the first and second parts is formed of a sheet of thermoformable material. The sheet of the first part has a different thickness or density than the sheet of the second part. The first part extends over the foot and the second extends around the ankle. A third part can be joined in edge-to-edge relationship to the first and second parts and extends over the top of the foot.

9 Claims, 3 Drawing Sheets

THERMOFORMABLE MULTI-PART SLIPPER

BACKGROUND OF THE INVENTION

1. Field of the Invention

The present invention relates to components that are intended to fit a portion of the body for the purpose of increasing the comfort of that portion of the body or for carrying out a prosthetic function, such as supporting or holding organs that have been displaced by accident and substituted by artificial mechanisms. The present invention relates to such components that can be thermoformed on the body or on a rigid thermoforming structure. The present invention also relates to such components that can be used as footwear designed to ensure a calculated support of the foot and to be worn within a generally rigid shoe.

2. Description of Related Art

Known slippers to be made to fit the foot of the user. If necessary, such slippers can undergo a second thermoforming in a rigid shell formed by the shoe into which the slipper is inserted.

French Patent No. 94.10939 describes a slipper that consists of a part designed to receive the foot and a part that is roughly tubular so as to surround the bottom of the leg. This slipper also contains flaps. This slipper is made of a comfortable material between the foot and the shoe so that it conforms to the foot of the user. In this prior art patent, this comfortable material is made of a thermoplastic and/or thermoformable material that is made malleable by heating.

International Patent Application No. WO 94/09663 also describes a slipper of the same type. This slipper is made of a single piece with an axial seam. The slipper is equipped, at the joint of the ankle and the tibia, with flaps that fold onto each other. This slipper is also made of a thermoformable material that is able to be formed at a temperature that the user can tolerate. The technique of this item of prior art makes it possible to obtain a formable shape which allows for the adjustment of the foot in the shoe in order to obtain precise positioning of objects fixed to the shoe, such as a ski.

When in use, these known slippers are not properly designed. In particular, notably in the case of ski boots, the internal dimensions of the rigid shell are such that it is as close as possible to shape of the foot. It is necessary that the slipper conforms both the form of the foot and to that of the shell and that both a correct tightening of the ankle/tibia joint be obtained. Another problem of the slippers of the prior art is that are made of a single piece (as described in International Patent Application No. WO 94/09663) or of two pieces (as described in French Patent No. 2 724 295). If they obtain a proper tightening around the ankle-tibia joint, there is little space for the foot. As a result, the foot is not able to spread out properly. In addition, the covering of the instep or the portion in front of the ankle-tibia articulation zone is done with overlapping flaps. This creates an excessive thickness that generates a pressure on the foot. As a result, the shoe will fit uncomfortably.

The examples of the problems of the prior art in the field of making the slippers are common to all scenarios involving the use of thermoformable materials utilized in prosthetic applications.

BRIEF SUMMARY OF THE INVENTION

The present invention is intended to overcome the disadvantages of the prior art by creating a slipper having waterproof seams and which allows a proper tightening of the foot within the shoe while also allowing a spreading of the foot and a tightening in the area of the joint of the ankles and the tibia. The present invention creates a prosthetic or comfortable component for the body made of several assembled parts which are waterproof at the junctions of the parts. These parts do not have excessive thickness at these junctions. The parts have different thicknesses or densities.

The present invention is a component designed to fit a portion of the body for the purpose of increasing the comfort of that portion of the body or for carrying out a prosthetic function of supporting or holding organs that have been replaced by artificial mechanisms. This component can be thermoformed on the body or in a shell that contains the component. The component is made from materials of cut sheets which are thermoformable at a temperature suitable to the body. The component is characterized in that it is made of at least two cut and assembled parts. The sheets that form the thermoformable material of the first and second parts have different thicknesses or different densities.

The parts of the component of the present invention are assembled by gluing, bonding or sewing. The parts are joined in edge-to-edge relationship to each other. The edge of the part having the greater thickness is fitted to adjust the thickness of the part of lesser thickness.

The first part surrounds the foot so as to be closed under the sole of the foot. The second part surrounds the ankle and is mounted to the first part. The first part has a lesser thickness than the second part.

DETAILED DESCRIPTION OF THE INVENTION

The component according to the present invention is of a type designed to fit a portion of the body for the purpose of increasing the comfort of that portion of the body. The present invention can be a slipper, either for walking with a sole, or designed to be worn within a shoe.

The component according to the present invention can also be designed to carry out a prosthetic function for supporting or holding organs that have been replaced by artificial mechanisms, for example, a slipper designed to support the sole of the foot in the arch of the foot or designed to adjust the position of the toes. The prosthetic device can be a pin, a ball and a socket joint, a corset, a surgical collar, a splint for supporting the leg, or any other component used for prosthetic function in humans or animals. The component can be made of a sheet material that can be cut, sewn, glued, or bonded.

The component according to the present invention can be placed in a shell or cup. The component is made from sheet materials that can be cut, glued, sewn or bonded. The material of the component of the present invention can be thermoformed onto the body or formed within a shell that contains the material. For example, a first thermoforming can be made onto the body or onto a structure that reproduces that component of the body. A second thermoforming can be carried out in a shell.

The attached drawings of FIGS. 1–7 represent a component that forms a slipper designed to be worn within a shoe. This slipper is made of a sheet material that can be cut and sewn. The material can also be glued or bonded with heat by localized melting. The material is thermoformable at a temperature that can be tolerated by the user and thus suited to the human body. The temperature of thermoforming is relatively low. The slipper according to the present invention is designed to be worn within a sport shoe or a shoe having a soft shell, a semi-rigid shell, or a rigid shell, such as ski boots.

Figure 1:
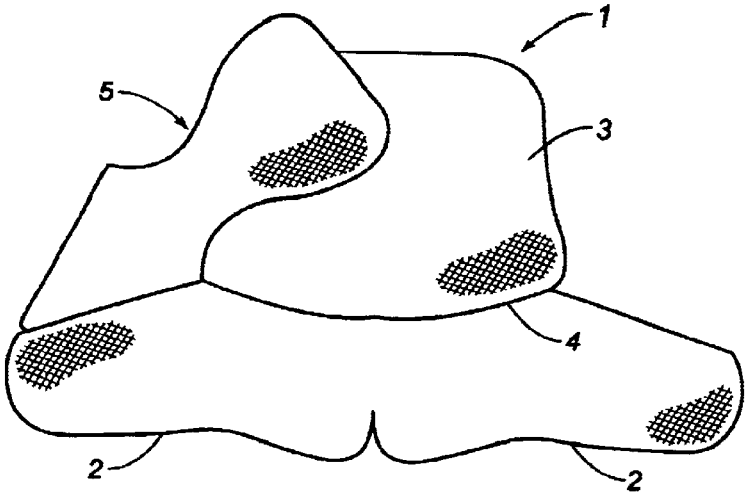
FIG. 1 is an exploded view of the parts that form the slipper according to the present invention.

The thermoformable slipper according to the present invention is made of a first part 1. This first part 1 is shown in FIG. 1 in a flattened configuration. The first part 1 is closed along its longitudinal axis corresponding to the sole of the foot at the junction of the two lower edges 2. The first part 1 will surround the foot. The slipper also includes at least one second part 3 which is affixed along the upper edge 4 of part 1.

In FIG. 1, parts 1 and 3 are illustrated in a flattened condition. Part 3 surrounds the ankle and the area of the joint of the ankle and the tibia. Part 3 has a shape that is roughly tubular after it is positioned so as to conform around the angle and the tibia. Part 3 includes a frontal part or a front portion above the instep of the foot. Part 3 can include flaps that fold on each other so as to ensure closing and waterproofing.

Figure 2:
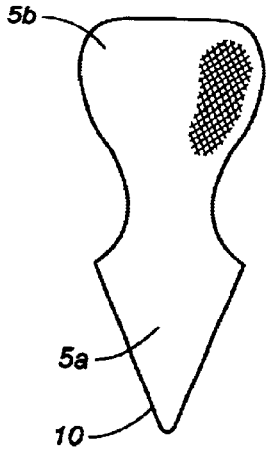
FIG. 2 is a view of the component that forms the obturating tongue.
Figure 3A:
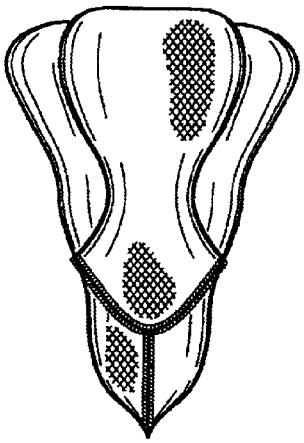
FIG. 3A is a view of the front of the slipper assembled prior to thermoforming.
Figure 3B:
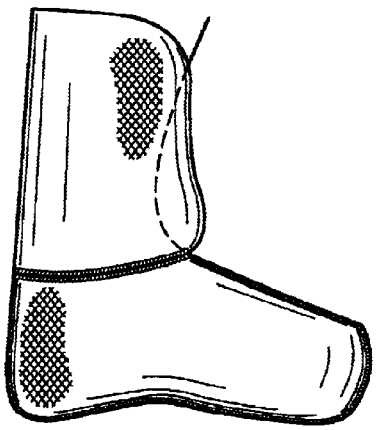
FIG. 3B is a view of the side of the slipper assembled prior to thermoforming.

The slipper has a part 5 which has a front portion in the shape of a triangular area 5A, as illustrated in FIG. 2. Part 5 is affixed to part 1 on the upper of the slipper in order to cover the top of the foot and extend toward the rear into an open portion 5B forming the obturating tongue. This obturating tongue is located between the vertical edges of the tubular part 3, as illustrated in FIG. 3. The top of the triangular area 5A can also be rounded.

In the present invention, the cut thermoformable sheet materials that are used to make the first part surrounding the foot and the second part surrounding the ankle of either totally or partially different thickness or densities or also having different flexibilities and rigidities. Preferably, part 2 is thicker than part 1. Because part 1 is less thick, it allows for more space within the shoe so as to allow a comfortable spreading of the foot. Since part 1 is less thick, it also remains more flexible after thermoforming. Part 3 is more rigid than part 2 so as to ensure a proper support of the ankle. Part 2, in the preferred embodiment of the present invention, has a thickness of 10 millimeters while the part 1 will have a thickness of approximately 5 millimeters. Part 2 has a greater density than either part 1 or part 3.

The component according to the present invention is made of at least two parts. The sheets that form these parts have different thicknesses or densities. The component of the present invention is made of N parts assembled in a manner in that at least one of the N parts has a sheet with a thickness or density different than the others. The sheet can correspond to the part which holds the organs that have been replaced by artificial mechanisms.

In the preferred embodiment of the present invention, part 5 is made of a thermoformable sheet material having the same thickness as part 3 which surrounds the ankle. However, within the present invention, it is possible that part 5 is thicker than part 1 and can be of a different thickness than either part 1 or part 3. Also, in accordance with an alternative embodiment of the present invention, the sheet material used for the parts 1, 3 and 5 can be thicker for part 3 which is the top of the shoe, and for part 5. In another embodiment of the present invention, part 1 can be thicker than the upper part 3 which surrounds the ankle.

Figure 4:
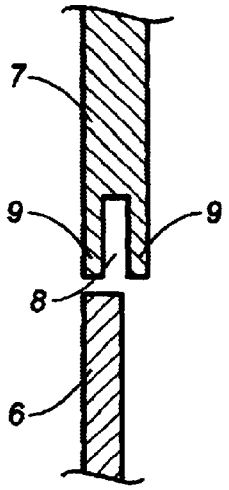
FIGS. 4–6 represent, in a schematic manner, the assembly of the pieces that form the slipper of the present invention.
Figure 5:
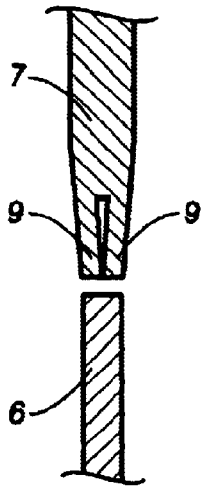
Figure 6:
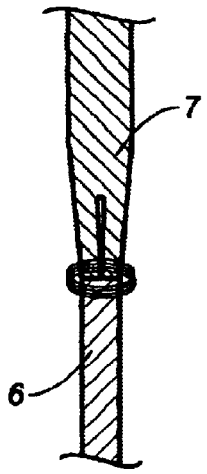
Figure 7:
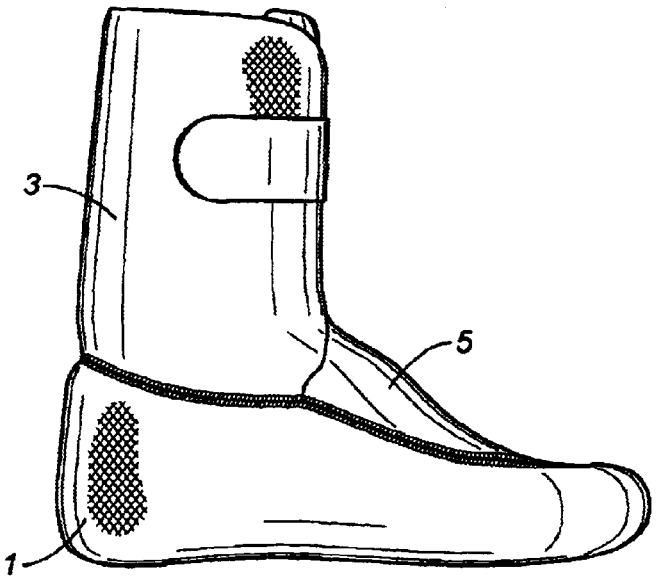
FIG. 7 is a side view of the thermoformed slipper.

The assembly of the parts can be carried out by sewing the parts in edge to edge relationship, as shown in FIGS. 4–6. In FIG. 4, sheet 6 corresponds to one of the parts of lesser thickness, such as part 1. Sheet 7 shows a sheet corresponding to the part having greater thickness, such as either part 3 or part 5. During the sewing of the sheets 6 and 7 in edge-to-edge relationship, the difference in the thicknesses can create an area which is uncomfortable for the user.

In the present invention, the part is fitted, along its cut edge, so as to adjust the thickness over the part having lesser thickness. This adaptation, as shown in FIGS. 4–6, is obtained by creating an engraved groove 8 along the cut edge of the sheet so as to form two parallel tongues 9. During the assembly, the groove 8 is filled with glue. As shown in FIG. 5, the tongues 9 are brought together so as to close the groove 8. As a result, the cut edge of sheet 7 will be roughly the same thickness as the sheet 6. The sheets 6 and 7 are thus joined, as shown in FIG. 6, in edge-to-edge relationship along their glued section by the glue which coats the tongues 9 and is contained within the groove 8. These edges can be suitably sewn, as shown in FIG. 6. This allows a proper assembly of the parts without an excess thickness area. This manner of assembly also makes the present invention more watertight.

This same type of assembly can be carried out when the slipper is equipped with one piece 5, as shown in FIG. 2, which is sewn by the sides 10 at portion 5A and which is of a larger thickness than the sheet forming part 2. The glue can be replaced by edge-to-edge bonding with localized heating. The adaptation of the cut edges of the sheets for the assembly can be carried out in a different manner than stated above. For example, it is possible to compress the material that is thickest beyond its limit of elasticity by heating. As such, it will have the same thickness as that of narrower sheet of material. It is also possible to machine or abrade the sheet so as to reduce the thickness.

Figure 8:
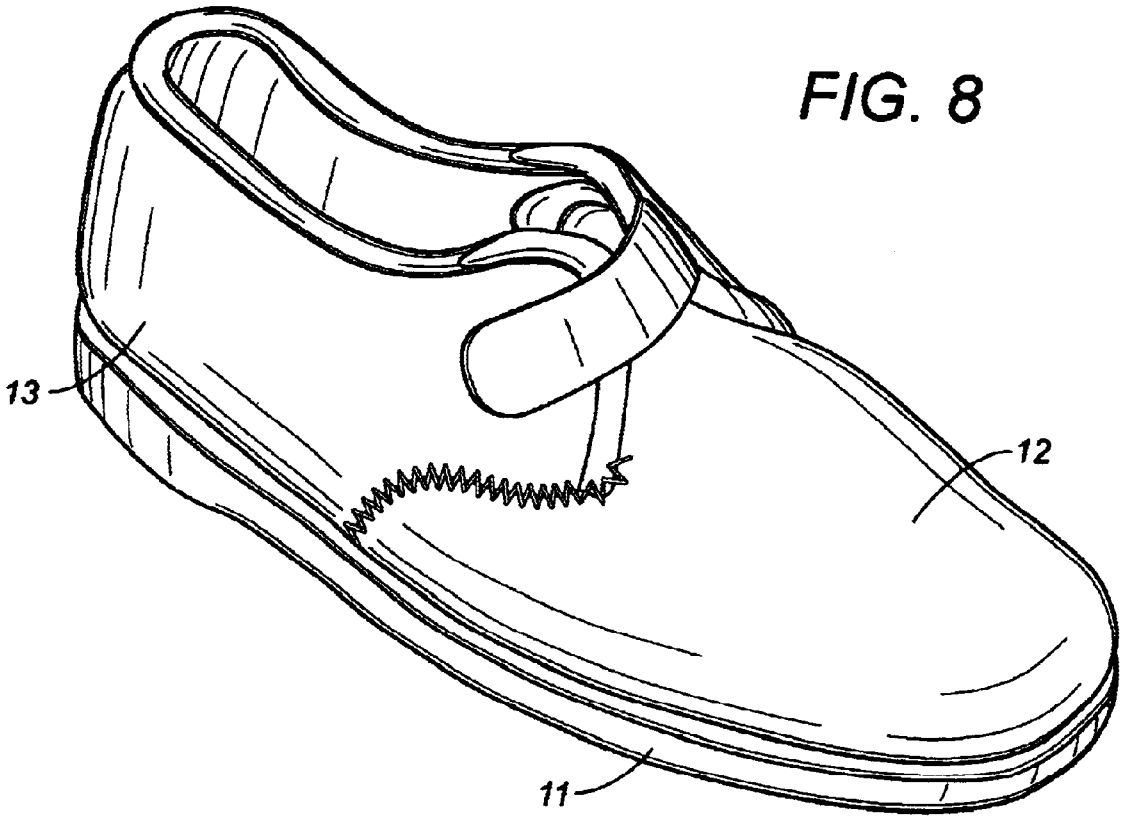
FIG. 8 shows a component in accordance with the present invention that is made of footwear having a sole.

FIG. 8 shows the footwear having a sole 11 assembled in a traditional manner with an upper 12 and a rear part 13. The upper 12 and the rear part 13 are either of a different thickness, or of a different density depending on the type of prosthetic function that would be assigned to them. At least one of the parts can be made of a non-thermoformable material.

I claim:

1. A device for fitting onto a tibia and an ankle and a foot of a human body comprising:

a thermoformable element comprising a first part means for surrounding a portion of the foot and a second part means suitable for surrounding a portion of the ankle and the tibia, said second part means having a greater thickness than said first part means, said second part means having an edge with a groove formed between two tongues, each of said two tongues having an edge facing an edge of said first part means, the edges of said two tongues being juxtaposed against each other and joined to said edge of said first part means such that an inner surface and an outer surface of said first part means adjacent the edge thereof being flush with an inner surface and an outer surface respective of said second part means adjacent the edge thereof, a total thickness of said two tongues having a thickness equal to a thickness of said first part means at the edge thereof.

2. The device of claim 1, further comprising a third part formed of a sheet of nondeformable material, said third part being joined in edge-to-edge relationship to at least one of said first and second part means.

3. The device of claim 2, said third part having a thickness equal to a thickness of said second part means.

4. The device of claim 1, said first part means for surrounding the foot and for being closed below the foot, the device further comprising:

a third part means for covering a top of the foot, said third part means being joined in edge-to-edge relationship to each of said first and second part means.

5. The device of claim 1, said two tongues being glued together.

6. The device of claim 1, said groove being filled with glue.

7. The device of claim 1, the edges of said second part means being secured to the edge of said first part means.

8. The device of claim 1, the edges of said second part means being bound to the edge of said first part means.

9. The device of claim 1, said first and second part means for thermoforming on the foot and the ankle of the human body.

* * * * *